US007904299B2

(12) United States Patent
Gandhi et al.

(10) Patent No.: US 7,904,299 B2
(45) **Date of Patent: *Mar. 8, 2011**

(54) METHOD, SYSTEM, AND APPARATUS FOR MONITORING SECURITY EVENTS USING SPEECH RECOGNITION

(75) Inventors: Shailesh Gandhi, Boca Raton, FL (US); Pradeep Mansey, Coral Springs, FL (US); Anilkumar B. Patel, West Palm Beach, FL (US)

(73) Assignee: Nuance Communications, Inc., Burlington, MA (US)

( * ) Notice: Subject to any disclaimer, the term of this patent is extended or adjusted under 35 U.S.C. 154(b) by 471 days.

This patent is subject to a terminal disclaimer.

(21) Appl. No.: 12/029,317

(22) Filed: Feb. 11, 2008

(65) Prior Publication Data

US 2008/0215334 A1 Sep. 4, 2008

Related U.S. Application Data

(63) Continuation of application No. 10/736,248, filed on Dec. 15, 2003, now Pat. No. 7,376,565.

(51) Int. Cl.
*G10L 21/06* (2006.01)

(52) U.S. Cl. ..... 704/274

(58) Field of Classification Search ..... 704/274
See application file for complete search history.

(56) References Cited

U.S. PATENT DOCUMENTS

| | | | | |
|---|---|---|---|---|
| 4,001,771 | A | 1/1977 | Amrine et al. | |
| 4,450,436 | A | 5/1984 | Massa | |
| 4,897,862 | A | 1/1990 | Nishihara et al. | |
| 6,064,303 | A | 5/2000 | Klein et al. | |
| 6,263,311 | B1 | 7/2001 | Dildy | |
| 6,281,792 | B1 | 8/2001 | Lerg et al. | |
| 6,552,963 | B2 | 4/2003 | Baranek et al. | |
| 6,964,023 | B2 | 11/2005 | Maes et al. | |
| 7,376,565 | B2 * | 5/2008 | Gandhi et al. | 704/274 |

FOREIGN PATENT DOCUMENTS

| | | |
|---|---|---|
| WO | WO 92/06456 | 4/1992 |

* cited by examiner

*Primary Examiner* — Susan McFadden
(74) *Attorney, Agent, or Firm* — Wolf, Greenfield & Sacks, P.C.

(57) ABSTRACT

A method of monitoring for security events using a speech recognition system can include receiving a sound signal within the speech recognition system and determining at least one attribute of the sound signal. The attribute of the sound signal can be compared with one or more acoustic models associated with a security event. The method can further include identifying the sound signal as a security event according to the comparing step.

20 Claims, 2 Drawing Sheets

METHOD, SYSTEM, AND APPARATUS FOR MONITORING SECURITY EVENTS USING SPEECH RECOGNITION

CROSS REFERENCE TO RELATED APPLICATIONS

This application is a continuation of, and accordingly claims the benefit from, U.S. patent application Ser. No. 10/736,248, now issued U.S. Pat. No. 7,376,565, which was filed in the U.S. Patent and Trademark Office on Dec. 15, 2003.

BACKGROUND

1. Field of the Invention

The invention relates to the field of security and, more particularly, to the use of speech recognition to provide security functions.

2. Description of the Related Art

Electronic home security systems have been available to consumers for many years. Typically these systems are micro-processor-based, and include a variety of sensors, such as photo detectors, motion detectors, and sound detectors. In normal operation, these standalone systems monitor the sensors to detect unusual or suspicious events, such as a discontinuity in the input data stream that rises above a certain threshold. Such a discontinuity could result from a window breaking or loud footsteps, which could indicate that an intruder has entered the monitored area. However, the high cost of these systems, the extensive installation required, as well as the proliferation of personal computers (PCs), have given rise to home security systems which can be implemented as software programs running on commercially available PCs.

PC-based home security systems typically include input devices, such as microphones and/or a video cameras, which are directly attached to the PC. As is well known in the art, these systems essentially listen and watch through the microphone and/or video camera for significant changes to the normal background environment of the house, such as a sharp rise in the overall sound level within the home above some threshold sound level or a rapid change from dark to light within the home. Upon determining that the significant change is of an unusual or suspicious nature, the system can take appropriate remedial action, such as calling a fax machine and sending a fax-based message, or broadcasting a voice message over a modem.

One disadvantage of existing PC-based alarm systems is the inherent susceptibility to nuisance tripping and false alarms. That is, these systems normally rely on complex and cumbersome algorithms and metric tables to determine whether the significant change warrants any remedial action. It is difficult, if not impossible, however, to anticipate every sound that may be interpreted as a suspicious event. For example, a neighbor's window breaking or construction noise outside the house being monitored could cause an alarm message to be sent to a police station. Although more sophisticated PC-based alarm systems can be configured to monitor the environment for a period of time in order to create a model of a typical environment during a certain time of the day, these systems require continual calibration as the environment changes.

Accordingly, there is a need to develop improved alarm and/or sound detection systems.

SUMMARY OF THE INVENTION

The present invention provides a method, system, and apparatus for integrating speech recognition technology and alarm systems. The present invention can utilizes acoustic models specific to a security event for which a user may desire notification, such as the sounding of a home fire alarm, burglar alarm, or window glass shattering. The present invention can compare incoming sound signals to one or more acoustic models to determine whether a security event has occurred. If a security event is identified, the system takes remedial action, such as sending an e-mail, instant message, or text message to the user's communication device, such as a PDA or cell phone, describing the event. Additionally, the present invention can send messages with an embedded recording of the sound signal so the user can hear the security event prior to taking remedial action, such as contacting the police, fire department, and the like. The system also can send alarm messages indicating a system operation failure, such as a power outage, a firewall intrusion, and a disk space low condition.

One aspect of the present invention can include a method of monitoring for a security event using a speech recognition engine. Notably, the speech recognition engine can be disposed within a personal computer. The method can include receiving a sound signal within the speech recognition engine, determining one or more attributes of the sound signal, comparing the attributes of the sound signal with one or more acoustic models associated with the security event, and identifying the sound signal as the security event according to the comparing step. The method can also include notifying a user over a specified communications channel responsive to identifying the security event.

In one embodiment of the present invention, a message describing the detected security event can be sent over a specified communications channel. For example, the message can be sent over an Internet communication channel, a wireless communication channel, and/or a telephony communication channel. The method further can include sending a recording of the sound signal with the message. The user also can be notified of a system failure.

The receiving step can include detecting an acoustic sound through a transducer communicatively linked to the speech recognition engine. The sound signal can specify a sound of an alarm, glass breaking, a person walking, an animal noise, or a human voice.

Other embodiments of the present invention can include a machine readable storage for causing a machine to perform the steps described herein as well as a system having means for performing the steps disclosed herein.

BRIEF DESCRIPTION OF THE DRAWINGS

There are shown in the drawings, embodiments which are presently preferred, it being understood, however, that the invention is not limited to the precise arrangements and instrumentalities shown.

DETAILED DESCRIPTION OF THE INVENTION

The invention provides a solution for integrating speech recognition in alarm systems. In particular, a speech recognition system can be configured to create customized acoustic models specific to security events, such as the sounding of a home fire alarm or breaking window glass. Accordingly, the system can be configured to compare incoming sound signals with the aforementioned acoustic models to determine whether a security event has occurred. Upon detection of a security event, the system can notify a user over a selected communication channel. For example, the user can be contacted by sending an instant message, e-mail or text message to a device capable of communicating over the Internet, such as cell phones, personal digital assistants (PDAs), or other computing/communication device belonging to or designated by the user. Additionally, a recording of the incoming sound signal can be embedded within or sent with the message so the receiving party or user can hear the detected sound and provide confirmation prior to the system taking any further action.

Figure 1:
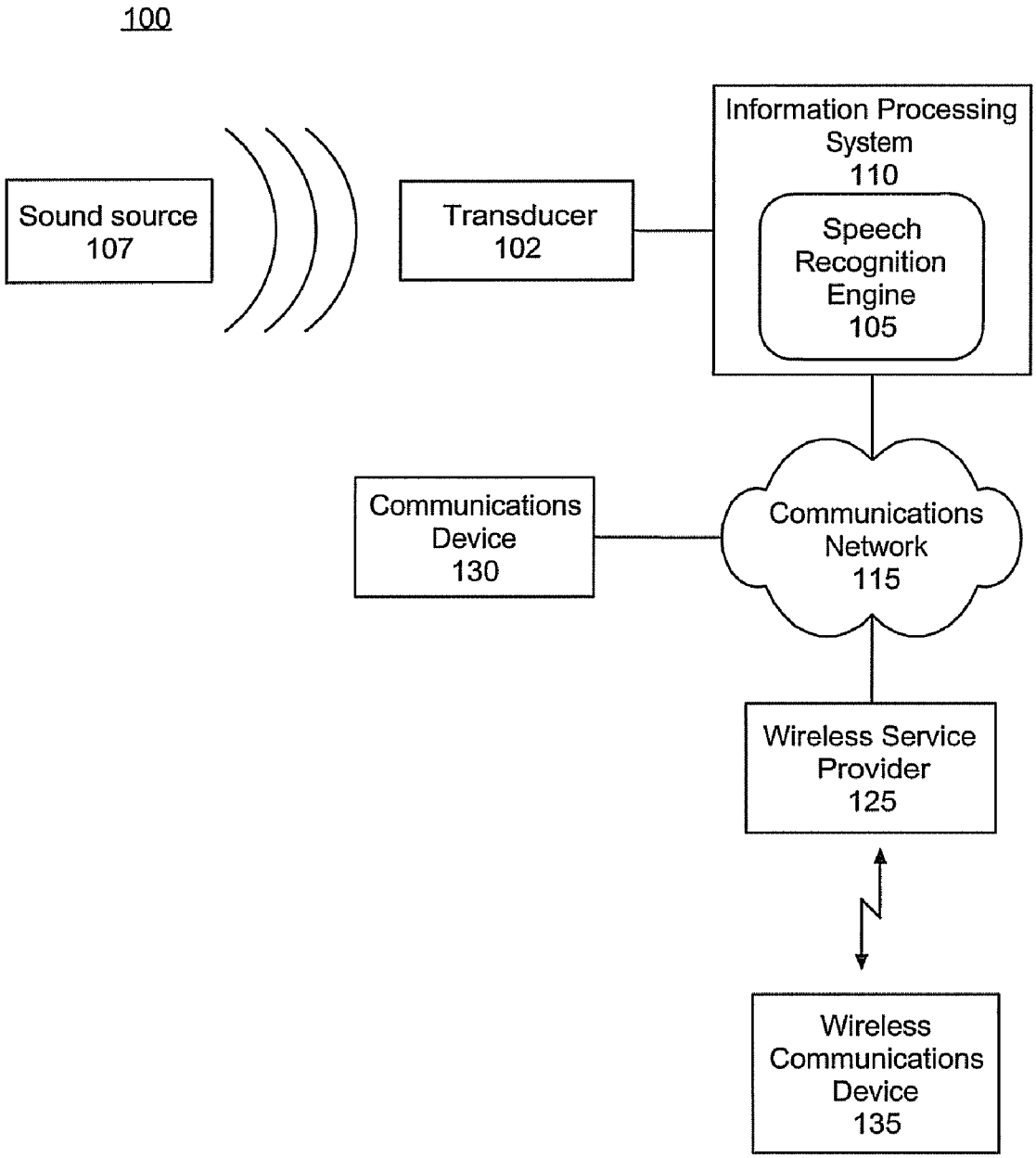
FIG. 1 is a schematic diagram illustrating a system for monitoring for security events in accordance with the inventive arrangements disclosed herein.

FIG. 1 is a diagram of an exemplary system 100 for monitoring for the occurrence of a security event using a speech recognition system. As shown in FIG. 1, system 100 can include a transducer 102 and an information processing system 110.

The transducer 102 can be an electronic device, such as a microphone, that converts an acoustic sound from an acoustic sound source 107 to an analog electrical signal. The transducer 102 can be communicatively linked to the information processing system 110. The transducer 102 can detect acoustic sounds from any sound source 107 including, but not limited to, human beings, animals, breaking glass, opening doors, and the like. While FIG. 1 illustrates a single transducer 102 connected to the information processing system 110, those skilled in the art will appreciate that a plurality of wired and/or wireless transducers can be installed in different areas, such as different rooms in a house, and connected to information processing system 110.

The information processing system 110 can be implemented as any type of computer system such as a home or personal computer system, a laptop, or other information processing appliance that can be communicatively linked to the transducer 102. It should be appreciated that the information processing system 110 can be located within a private residence, a place of business, or any other location where security monitoring is required.

The information processing system 110 can include suitable audio circuitry so as to digitize received electronic sound signals from the transducer 102. The information processing system 110 also can be configured to execute a Speech Recognition Engine (SRE) 105. It should be appreciated that while the transducer 102 is depicted as being separate from the information processing system 110, the transducer 102 also can be integrated as part of the audio system of the information processing system 110.

The SRE 105 can be a software application executing within the information processing system 110. The SRE 105 can process digitized audio signals, process the signals, and develop acoustic models of the received audio signals. The acoustic models specify particular attributes of the audio signals which allow the SRE 105 to recognize that audio signal when received again at some time in the future. The SRE 105 can be configured to allow users to create acoustic models of various sounds indicative of security events. For example, the SRE 105 can include, or allow a user to create, enrollments (acoustic models) of sounds such as alarms, whether fire, burglar, or carbon monoxide, breaking glass, animal noises, footsteps, doors opening, or any other sound. Each enrollment or acoustic model can be associated with a particular security event, whether merely a name for the sound, or a more detailed description or warning of the event to be provided within a message to the user.

The information processing system 110 can be communicatively linked to a communications network 115. The communications network 115 can include, but is not limited to, the Internet, a wide area network (WAN), a local area network (LAN), the public switched telephone network (PSTN), and cable data networks. Accordingly, the information processing system 110 can send messages to a communications device 130 via the communications network 115. The communications device 130 can be any communications device capable of establishing a communications link with the communications network 115. For example, the information processing system 110 can send emails, instant messages, facsimile transmissions, and initiate Voice Over Internet Protocol (VoIP) calls to the communications device 130, which can be a PDA, a computer system, or the like.

As shown, the communications network 115 also can be communicatively linked to a wireless service provider 125, for example through a suitable gateway interface (not shown). The wireless service provider 125 can provide wireless connectivity to a wireless communications device 135. For example, the wireless service provider 125 can provide connectivity to wireless communications devices 135 such as mobile devices, including cellular phones and pagers, and PDAs, thereby allowing the information processing system 110 to send messages to the wireless communications device 135. Such messages can include, but are not limited to, text messages, mobile calls, emails, and the like.

It should be appreciated that in the case where the communications network 115 is the PSTN, that the information processing system 110 also can send facsimile transmissions and place telephone calls to a designated telephone number. Regardless, the information processing system 110 can send notifications to a user over a specified communications channel to a specified receiving address or number.

Figure 2:
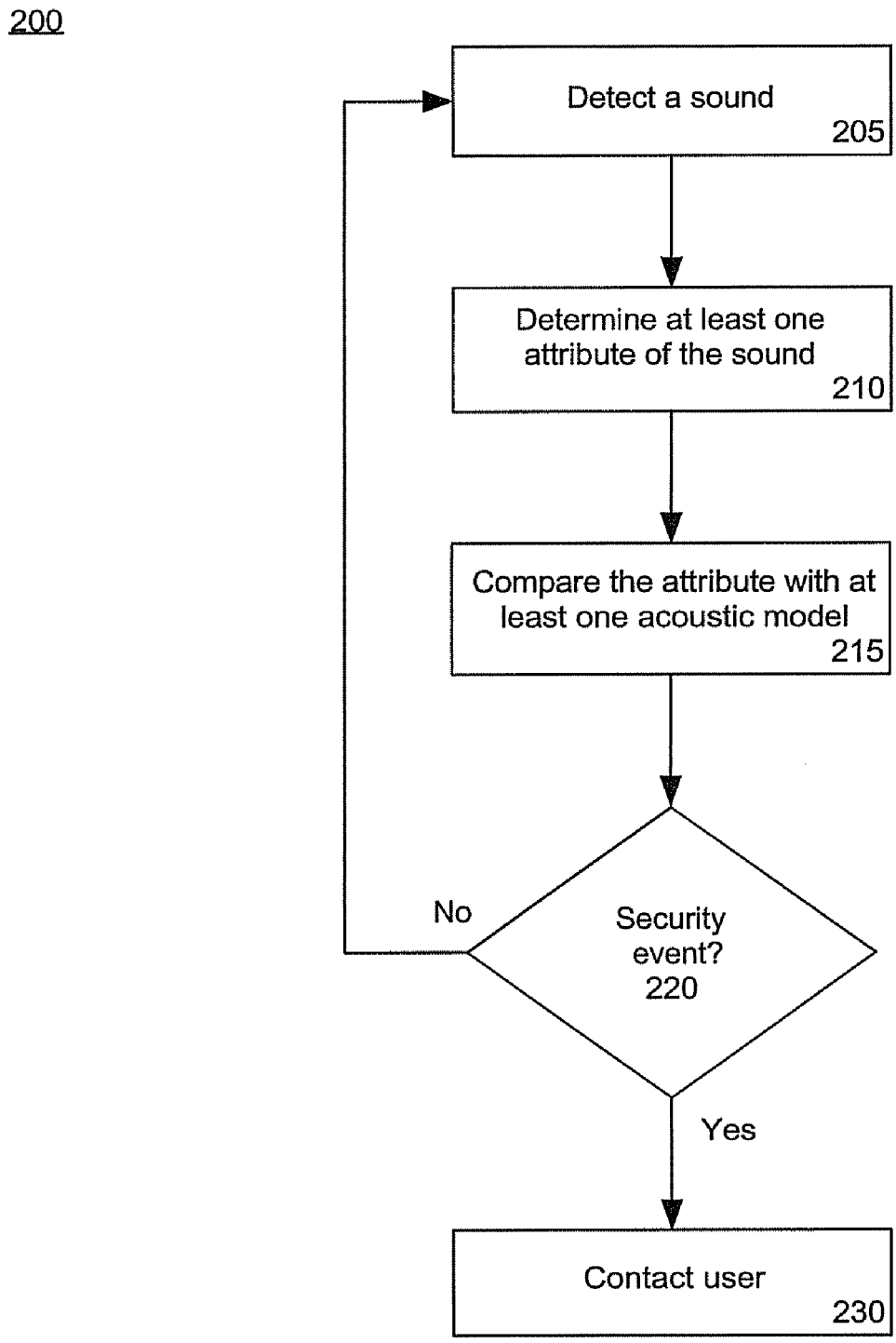
FIG. 2 is a flow chart illustrating a method of monitoring for security events in accordance with the inventive arrangements disclosed herein.

FIG. 2 is a flow chart illustrating a method 200 of implementing a SRE for use in performing security functions in accordance with the system of FIG. 1. The method 200 can begin in a state where an information processing system is executing a SRE having one or more acoustic models corresponding to particular security events. In one embodiment of the present invention, the SRE can be configured to continually monitor digital sound signals provided through the audio circuitry of the information processing system. According to another embodiment, the SRE can be configured to monitor sound signals only during pre-determined time intervals, for example, when the homeowner is not in the house.

The method 200 can being in step 205, where the system can detect a sound. For example, the SRE can continuously monitor received digital audio signals until a recognition event is detected. A recognition event can be a rise in the level or amplitude of the received audio signal above a particular threshold, effectively indicating that a sound has been detected that is not normal environmental or background noise. Still, the SRE can be configured to analyze all audio signals received, whether above a threshold or not.

The SRE can be configured to record received audio signals in temporary storage for comparison and processing. In one embodiment, the SRE can record an audio loop of a particular time frame. Upon detection of a recognition event, the SRE can be configured to store the recorded audio information in a more permanent fashion so as not to overwrite the recorded audio with newly received or subsequent audio.

In step 210, the SRE can determine at least one attribute of the received sound. The attributes of the received sound can be similar to, or the same as, the attributes or characteristics identified and stored within the acoustic models. In step 215, the SRE can compare any identified attributes of the detected sound to one or more of the acoustic models. As noted, each acoustic model can be associated with a particular security event. For example, in a private residence, a security event can correspond to the sounding of an alarm, the sound of breaking of glass, or another sound.

In step 220, if a security event is not identified, then the system can loop back to step 205 can continue processing. If, however, in a match is found between an acoustic model for a security event and the received sound, the system can proceed to step 230 and take appropriate remedial action, such as notifying the user that a security event has occurred.

In step 230 the system can be configured to take appropriate remedial action, such as notifying the user that a security event has occurred. For example, the system can send the user a message describing the detected security event. In one embodiment of the present invention, the message can be an alarm message sent to a wireless communications device, such as a wireless telephone, pager, computer, or PDA, in the form of a text message, email, or instant message. In another embodiment, the system can connect via the voice enabled FAX/modem included in the PC to an outside telephone number and transfer over the connection one or more of a number of recorded alarm voice messages to be sent to a landline telephone or cell phone.

It should be appreciated by those skilled in the art that the aforementioned alarm messages can be customized depending on the identity of the receiver and the type of security event identified. In one aspect of the present invention, the system can send messages to the user indicating system operation failures. Such notifications can indicate power outages, firewall intrusions, disk space low conditions, and the like. The messages further can specify the type of sound that was detected as indicated by the matched security event (acoustic model).

In another embodiment of the present invention, the system can be configured to reduce false alarms by embedding or sending the recorded sound signal with the message. This embodiment allows the user to hear the actual detected sound before any other remedial action is taken. For example, the SRE can await a confirmation message from the user indicating that the detected sound was a security event prior to causing the information processing system to place a call to the proper authorities. In yet another embodiment, the system can be interfaced to a live Internet Web cam. Upon receipt of a message, the user can go to a home video Web site and view the actual video data stream of the monitored area. As described, the SRE can await confirmation from the user prior to taking any further remedial action, such as alerting the police, fire department, or the like.

The present invention allows one to effectively upgrade an existing alarm system which is incapable of notifying a user or owner of a detected problem. That is, the present invention can detect particular sounds using a speech recognition engine, and initiate communications based upon the interpretation of those detected sounds. Accordingly, the present invention can be used with legacy alarm systems to provide such systems with the ability to initiate communications over any of a variety of different communications channels responsive to detecting a particular sound that matches a stored acoustic model.

The present invention can be realized in hardware, software, or a combination of hardware and software. The present invention can be realized in a centralized fashion in one computer system, or in a distributed fashion where different elements are spread across several interconnected computer systems. Any kind of computer system or other apparatus adapted for carrying out the methods described herein is suited. A typical combination of hardware and software can be a general purpose computer system with a computer program that, when being loaded and executed, controls the computer system such that it carries out the methods described herein.

The present invention also can be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

This invention can be embodied in other forms without departing from the spirit or essential attributes thereof. Accordingly, reference should be made to the following claims, rather than to the foregoing specification, as indicating the scope of the invention.

What is claimed is:

1. A computer-readable non-transitory storage medium, having stored thereon a computer program having a plurality of code sections executable by a computer for causing the computer to perform a method comprising steps of:

receiving a sound signal with the speech recognition engine;

determining at least one attribute of the sound signal;

comparing the at least one attribute of the sound signal with at least one acoustic model associated with a security event;

notifying a user over a communications channel if, based upon comparison of the at least one attribute of the sound signal with at least one acoustic model, the sound signal is identified as the security event; and initiating a recording of an audio loop for a predetermined time frame to record other sounds signals if, based upon the comparison of the at least one attribute of the sound signal with at least one acoustic model, the sound signal is identified as the security event.

2. The computer-readable non-transitory storage medium of claim 1, wherein the method further comprises sending a message describing the security event over the communications channel.

3. The computer-readable non-transitory storage medium of claim 2, wherein the method further comprises sending a recording of the sound signal with the message.

4. The computer-readable non-transitory storage medium of claim 2, wherein the communication channel is an Internet communication channel.

5. The computer-readable non-transitory storage medium of claim 2, wherein the communication channel is a wireless communication channel and/or a telephony communication channel.

6. The computer-readable non-transitory storage medium of claim 2, wherein said sending further comprising comprises notifying the user of a system failure.

7. The computer-readable non-transitory storage medium of claim 1, wherein the speech recognition engine is disposed within a personal computer.

8. The computer-readable non-transitory storage medium of claim 1, wherein said receiving step comprises detecting an acoustic sound through a transducer communicatively linked to the speech recognition engine.

9. The computer-readable non-transitory storage medium of claim 1, wherein said sound signal specifies a sound of an alarm.

10. The computer-readable non-transitory storage medium of claim 1, wherein the sound signal specifies a sound of glass breaking, a person walking, an animal noise, or a human voice.

11. An apparatus comprising:

a speech recognition engine to receive a sound signal; and at least one processor programmed to;

determine at least one attribute of the sound signal;

compare the at least one attribute of the sound signal with at least one acoustic model associated with a security event;

notify a user over a communications channel if, based upon comparison of the at least one attribute of the sound signal with at least one acoustic model, the sound signal is identified as the security event; and initiate a recording of an audio loop for a predetermined time frame to record other sounds signals if, based upon the comparison of the at least one attribute of the sound signal with at least one acoustic model, the sound signal is identified as the security event.

12. The apparatus of claim 11, wherein the at least one processor is further programmed to send a message describing the detected security event over the communications channel.

13. The apparatus of claim 12, wherein the at least one processor is further programmed to send a recording of the sound signal with the message.

14. The apparatus of claim 12, wherein the communication channel is an Internet communication channel.

15. The apparatus of claim 12, wherein the communication channel is a wireless communication channel and/or a telephony communication channel.

16. The apparatus of claim 11, wherein the at least one processor is further programmed to send a message over the communications channel that describes the detected security event and notifies the user of a system failure.

17. The apparatus of claim 11, further comprising a personal computer that comprises the speech recognition engine and the at least one processor.

18. The apparatus of claim 11, further comprising a transducer that is communicatively linked to the speech recognition engine and detects an acoustic sound.

19. The apparatus of claim 11, wherein said sound signal specifies a sound of an alarm.

20. The apparatus of claim 11, wherein the sound signal specifies a sound of glass breaking, a person walking, an animal noise, or a human voice.

* * * * *

UNITED STATES PATENT AND TRADEMARK OFFICE

CERTIFICATE OF CORRECTION

PATENT NO. : 7,904,299 B2
APPLICATION NO. : 12/029317
DATED : March 8, 2011
INVENTOR(S) : Shailesh B. Gandhi et al.

It is certified that error appears in the above-identified patent and that said Letters Patent is hereby corrected as shown below:

At column 6, claim 6, lines 59-60, please change "further comprising comprises" to -- further comprises --.

Signed and Sealed this
Twelfth Day of April, 2011

David J. Kappos

David J. Kappos
*Director of the United States Patent and Trademark Office*